United States Patent [19]

Gram

[11] 4,299,075

[45] Nov. 10, 1981

[54] METHOD FOR PACKING ARTICLES INTO A NUMBER OF STRIPS OF PACKING MATERIAL AND APPARATUS FOR CARRYING OUT THE METHOD

[75] Inventor: Hans Gram, Vojens, Denmark

[73] Assignee: Brodrene Gram AS, Vojens, Denmark

[21] Appl. No.: 85,590

[22] Filed: Oct. 17, 1979

[30] Foreign Application Priority Data

Oct. 26, 1978 [DK] Denmark ..... 4764/78

[51] Int. Cl.[3] ..... B65B 9/06; B60B 51/30

[52] U.S. Cl. ..... 53/550; 53/546; 53/202; 53/373

[58] Field of Search ..... 53/450, 550, 553, 546, 53/568, 202, 373

[56] References Cited

U.S. PATENT DOCUMENTS

| | | | |
|---|---|---|---|
| 3,229,442 | 1/1966 | Gram | 53/550 X |
| 3,405,501 | 10/1968 | Edelberg | 53/550 X |
| 4,004,400 | 1/1977 | Anderson | 53/550 |
| 4,169,344 | 10/1979 | Ganz | 53/546 |

*Primary Examiner*—John Sipos

*Attorney, Agent, or Firm*—Watson, Cole, Grindle & Watson

[57] ABSTRACT

The method is of the kind whereby a number of strips of packing material is conducted through a cross section shaping station, through a filling station at which articles are arranged on the strips, through a longitudinally extending welding station at which each strip of material is welded into tube form, through a cross welding station wherein cross welding seams are made between the articles arranged in the packing tubes, and through a separation station for separating the finished packings from the strips of material. In order to obtain registration of the cross welding seams with respect to a preprinted pattern on the strips of material, the cross welding means are individually controlled as regards their disengagement from the strips of material by means of pulses issued by indication marks arranged along the strips of material and arranged with a pitch corresponding to the length of the packings to be produced. The invention also relates to an apparatus for carrying out the method.

3 Claims, 7 Drawing Figures

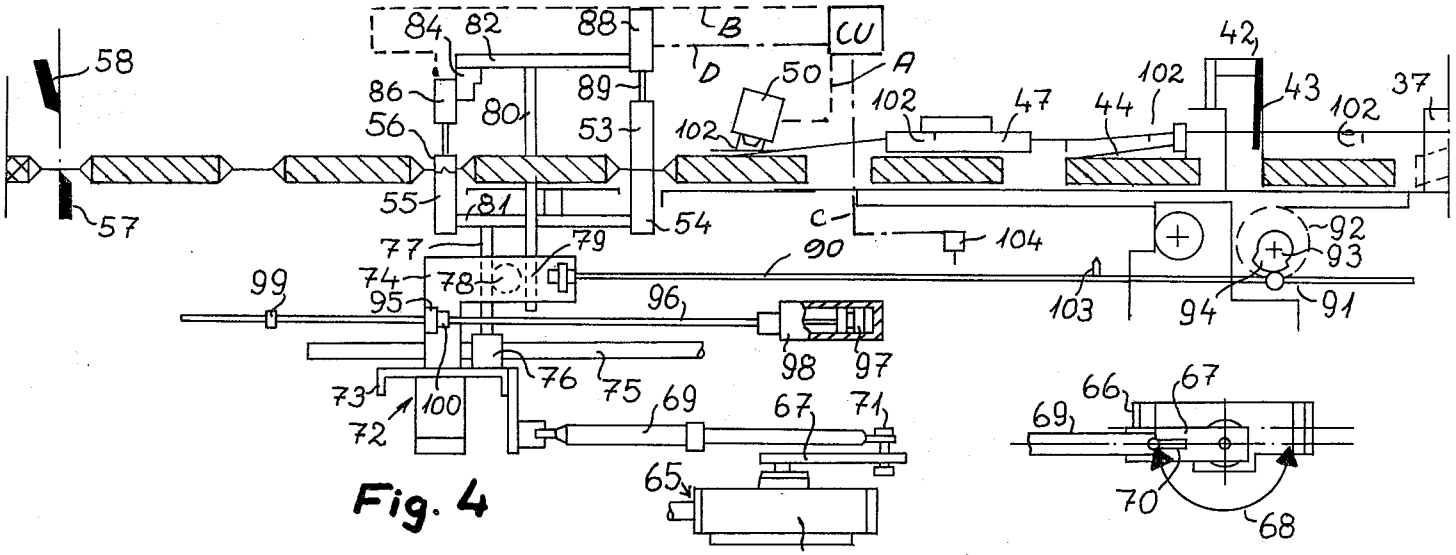
Fig. 4
Fig. 5
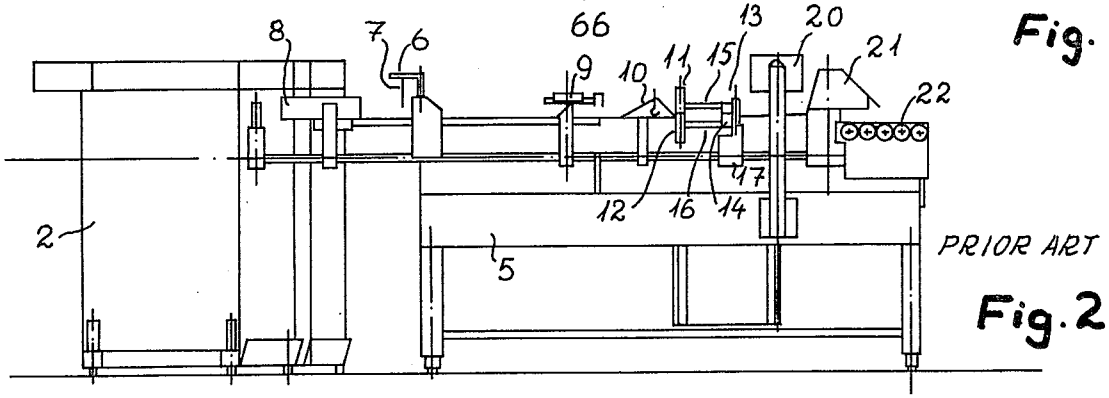
PRIOR ART
Fig. 2

METHOD FOR PACKING ARTICLES INTO A NUMBER OF STRIPS OF PACKING MATERIAL AND APPARATUS FOR CARRYING OUT THE METHOD

BACKGROUND OF THE INVENTION

The present invention relates to a method of packing articles and of the kind whereby a number of strips of packing material is conducted through a station wherein a cross section shape is applied to each strip in such a way that the strips may accommodate the articles to be packed, through a filling station at which articles are arranged into the strips, through a longitudinally extending welding station at which the longitudinally extending margins of each strip of material are welded together in order to form packing tubes, through a cross welding station comprising a set of heating welding means for heating the packing tubes between the articles and comprising a set of clamping welding means for clamping the heated parts of the packing tubes, and through a separation station comprising transverse cutting means and securing means and wherein a reciprocating stroke movement is applied to the sets of welding means belonging to the cross welding station, and said sets of welding means are moved for engaging and disengaging the strips of material.

By means of a known method of the kind referred to above, a stroke movement is used, the stroke length of which corresponds to the length of the packings to be produced, and the set of heating means and the set of clamping means are arranged with a mutual distance which corresponds to the length of the packings, and the two sets of welding means are moved for engaging the strips of material and moving the strips during the forward stroke movement, and during this stroke movement, the heating means heat the strips of material, caught by the heating means between the articles positioned in the strips of material and simultaneously the clamping means clamp the parts of the strips of material which were heated by the heating means during the preceding stroke movement. When the stroke movement has been completed, the sets of heating and clamping means are disengaged from the strips of material, and said sets of welding means are moved back to their starting position. During the return movement, the strips of material are secured by means of a combined cutting and securing device in such a way that the strips of material are not moved backwards together with the disengaged sets of welding means. When the sets of welding means have returned to their starting position, they are again moved for engaging the strips of material whereby the heating means will heat new parts of the strips and the clamping means will clamp the parts of the strips heated during the preceding stroke and will cool said parts in such a way that transverse seals are obtained.

As regards the prior art reference should be made to Danish Pat. No. 104,287 which, however, mentions one strip of material only, but later on the prior art known from said specification has been used in connection with packing machines adapted to more strips.

According to the known method, no difficulties exist as regards maintaining the areas of the packing tubes, at which the tubes are to be welded, free from articles. It is only necessary to position the articles in the strips of material at intervals which are longer than the areas to be welded and to locate such intervals at a definite distance from the reversing points of the stroke movement. However, it is difficult to provide for a synchronization of the strips of material with respect to the articles, in the following termed registration, in such a way that the articles always will be positioned at predetermined parts of the strips of material so that the cross weldings may be positioned at predetermined positions of the strips of material. Accordingly, strips of material have previously been used which are patterned in such a way that one pattern is repeated at comparatively short intervals, whereby it is achieved that it will be rather inconspicuous if a cross welding is positioned within a pattern. On the contrary, it is not possible to use strips, the patterns of which have a length of pattern corresponding to the length of the packing requested, because it previously has not been possible to secure that the cross weldings will be positioned exactly at the transitions between the patterns. This is due to the fact that, first of all, an uncertainty exists as regards the printing of the patterns upon the strips because an exact predetermined pitch of pattern cannot be secured. Moreover, during the cross welding, which comprises first a heating and then a clamping operation, a non-defined change of length of the strips of material occurs, and accordingly it is not sure that one and the same length of strip will be supplied to the apparatus during each of the strokes of the packing apparatus. Accordingly, it may easily happen that great errors of registration may occur, due to accumulations of small errors of registration, and accordingly the risk exists that a welding will be made between the ends of a pattern, even though it is requested to position the weldings between the patterns.

It is an object of the present invention to provide a method of the kind referred to above by means of which it is very simple to achieve a correct registration in such a way that identical pieces of strips of material form each final packing, and wherein each such piece of strip comprises a complete pattern or a multiple of complete patterns.

SUMMARY OF THE INVENTION

According to the invention this object is achieved by using a stroke of movement of the sets of welding means, the stroke length of which is longer than the length of the packings, and by disengaging at least one set of welding means individually for each strip by control from a registration indication upon each strip, and by carrying out such disengagement before the termination of the forward stroke of the cross welding station and at the earliest simultaneously with the disengagement of the other set of welding means. By this method the registration requested is achieved because a possibility of control within the stroke length of the stroke movement is possible in such a way that a pattern which is a little too long may be compensated for, by a correspondingly longer forward movement of the strip in question by means of the corresponding set or sets of welding means. On the other hand, a too short length of pattern may be compensated for, by an early disengagement of the corresponding set or sets of welding means, and such control is simple to carry out because a length of stroke is used which is identical for both sets of welding means, and which is constant from stroke to stroke, in such a way that the packing machine operating according to the method may be provided with a simple driving device as regards the welding means of the transverse welding station.

According to a preferred embodiment of the method only the clamping welding means, are disengaged individually whereas the other set of welding means, viz, the heating means, is disengaged simultaneously and before the disengagement of the clamping means and controlled by means of the forward stroke movement of the sets of welding means. By means of this embodiment a defined heating by means of the heating means may be achieved due to the fact that the heating means are in engagement with the strips of material during a constant part of each forward stroke movement, and, moreover, this embodiment is advantageous in that only the clamping means need to be divided corresponding to the number of strips in such a way that heating means may be used which are continuous as regards all the strips and, accordingly, in a simply way may be supplied with electric current for the heating.

According to a further advantageous embodiment of the method both sets of welding means are moved further in the direction of disengagement at the termination of the forward stroke. By means of this embodiment it is achieved that the movement of disengagement which is necessary in order to achieve the control of registration explained above, may be made small and, accordingly, may be carried out rapidly and easily, and, moreover, the means which in the known packing apparatus are used in order to cause the final disengagement of the heating means and of the clamping means at the termination of the stroke, may be used in order to cause this further movement in such a way that the apparatus may be simplified.

The invention also relates to a packing apparatus for carrying out the method and of the kind comprising: means for applying such cross section shape to each of a number of strips of packing material that the strips of material may accomodate the articles to be packed; a filling station comprising means for depositing the articles in the strips; a longitudinally extending welding station comprising means for welding the longitudinally extending margins of each strip of material together in order to form a packing tube; a cross welding station comprising both a set of heating welding means for heating the packing tubes between the articles and a set of clamping welding means for clamping the heated parts of the packing tubes; a separating station having transversely extending separating means and securing means; and driving means for applying a reciprocating stroke movement to the sets of welding means of the cross welding station, and means for moving said sets of welding means for engaging and disengaging the strips of material. According to the invention the packing apparatus is characterized by a driving device for the sets of welding means of the cross-welding station, the stroke length of which is greater than the length of the packings and by at least one of the sets of welding means is divided into elements corresponding to the number of strips of material which elements are connected with a number of disengaging devices corresponding to the number of strips of material, the disengaging devices being individually activatable, viz, by means of pulses caused by registration indications upon each of the strips of material, and the other set of welding means being disengagable at the latest simultaneously with the disengagement of the first mentioned set of welding means.

Further objects and advantages of the invention will be explained in more detail in the following.

BRIEF DESCRIPTION OF THE DRAWINGS

FIG. 2 is a front view of the packing apparatus shown in FIG. 1, FIGS. 3A, 3B and 3C show a packing line of an embodiment of the packing apparatus according to the invention, FIG. 4 is a side view of a part of the packing line shown in FIGS. 3A–3C for illustrating further details of the packing apparatus according to the invention, and FIG. 5 is a top view of a moving device for the packing apparatus.

DESCRIPTION OF THE PREFERRED EMBODIMENT

Figure 1:
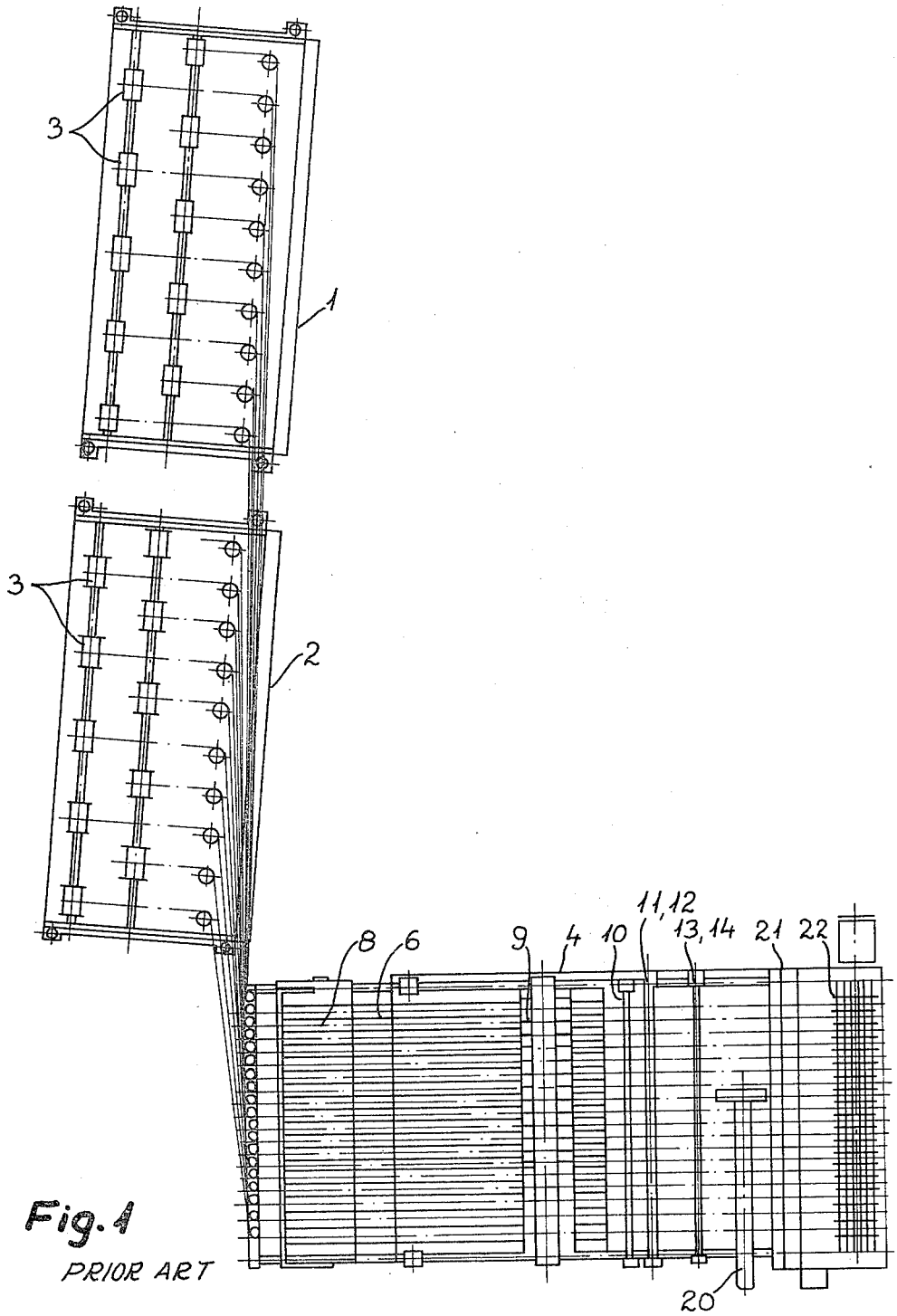
Fig. 1 PRIOR ART
FIG. 1 shows a top view of a known packing apparatus with a number of packing lines.

As mentioned above, the packing apparatus shown in FIGS. 1 and 2 belongs to the prior art and comprises two reel frames 1 and 2, each of which supports a number of rolls 3 of packing material, e.g. paper one or both sides of which is coated with a weldable material. The packing apparatus itself is in FIG. 1 designated 4 and comprises, as it appears from FIG. 2, a frame 5 which as seen in direction from the left to the right, supports a gallows 6 with downwardly projecting fingers 7, the number of which corresponds to the number of strips of packing material and which are aligned transversely with respect to the direction of the machine. Upstream with respect to the fingers and also arranged crosswise with respect to the direction of the machine, a row of shaping means 8 is arranged which apply a U-shaped cross-section to the strips of material during the passage of the strips through the shaping means. Between the shaping means and the fingers 7, the apparatus is provided with a depositing device (not shown) for depositing articles in the U-shaped strips. The articles are aligned crosswise with respect to the direction of the machine by means of the fingers 7. After the fingers 7, the frame 5 supports a set of longitudinally extending welding means 9 by which the longitudinally extending margins of each strip are welded together, and then a set of folding means 10 follows, in order to lay down the longitudinally extending welding seam made by the welding means 9. Then a set of heating means 11,12 and a set of clamping means 13,14 follow which together constitute a station for making transverse sealings. The set of heating means comprises a transverse upper rail 11 and a transverse lower rail 12 and the set of clamping means consists of an upper rail 13 and a lower rail 14. The two upper rails 11 and 13 are mutually connected by means of arms 15, and the two lower rails 12 and 14 are mutually connected by means of arms 16. The upper rail 13 and the lower rail 14 are connected to an engaging and disengaging device 17 by means of which the two upper rails 11, 13 may be moved upwards and the two lower rails 12, 14 simultaneously may be moved downwards. The distance between the heating means 11, 12 and the clamping means 13, 14 corresponds to the length of the packings to be made. The welding station comprising these two sets of means may be reciprocated by a driving device (not shown) in the direction of the machine with a length of stroke corresponding to the length of the packings to be made.

After the transverse welding station, a control panel 20 follows, and after the control panel 20 a cutting and securing station 21 and a roller conveyor 22 for separated packages follow.

The packing apparatus shown in FIGS. 1 and 2 operates in the following way:

Before starting the apparatus, the strips of material are passed through the shaping means 8, below the fingers 7, through the welding means 9 of the longitudinal welding station, through the means 10 for laying-down the longitudinally extending welding seams, between the upper and lower rails 11, 13 and 12, 14 respectively which have been moved away from each other, and towards and out through the cutting station 21. Accordingly, it will be understood that by applying a reciprocating stroke movement to the engaging and disengaging device 17 and by closing the rails of the transverse welding station before initiating the forward stroke, and opening the rails of the welding station at the end of the forward stroke, the strips of material will be passed stepwise through the apparatus, and articles which have been deposited in front of the fingers 7 and have been aligned by means of the fingers, will be enclosed in packings which will be separated with respect to the strips of material at the station 21.

By means of the apparatus shown in FIGS. 1 and 2, the strips of material will be provided with transverse weldings which will be completely without registration with respect to the strips, but of course weldings will be made between the articles positioned in the strips, because the fingers 7 provide for aligning the articles in the strips transversely with respect to the direction of the machine and, accordingly, adequate spacings will be secured between the articles, and transverse welding may be carried out at the spaces between the articles.

Figure 3A:
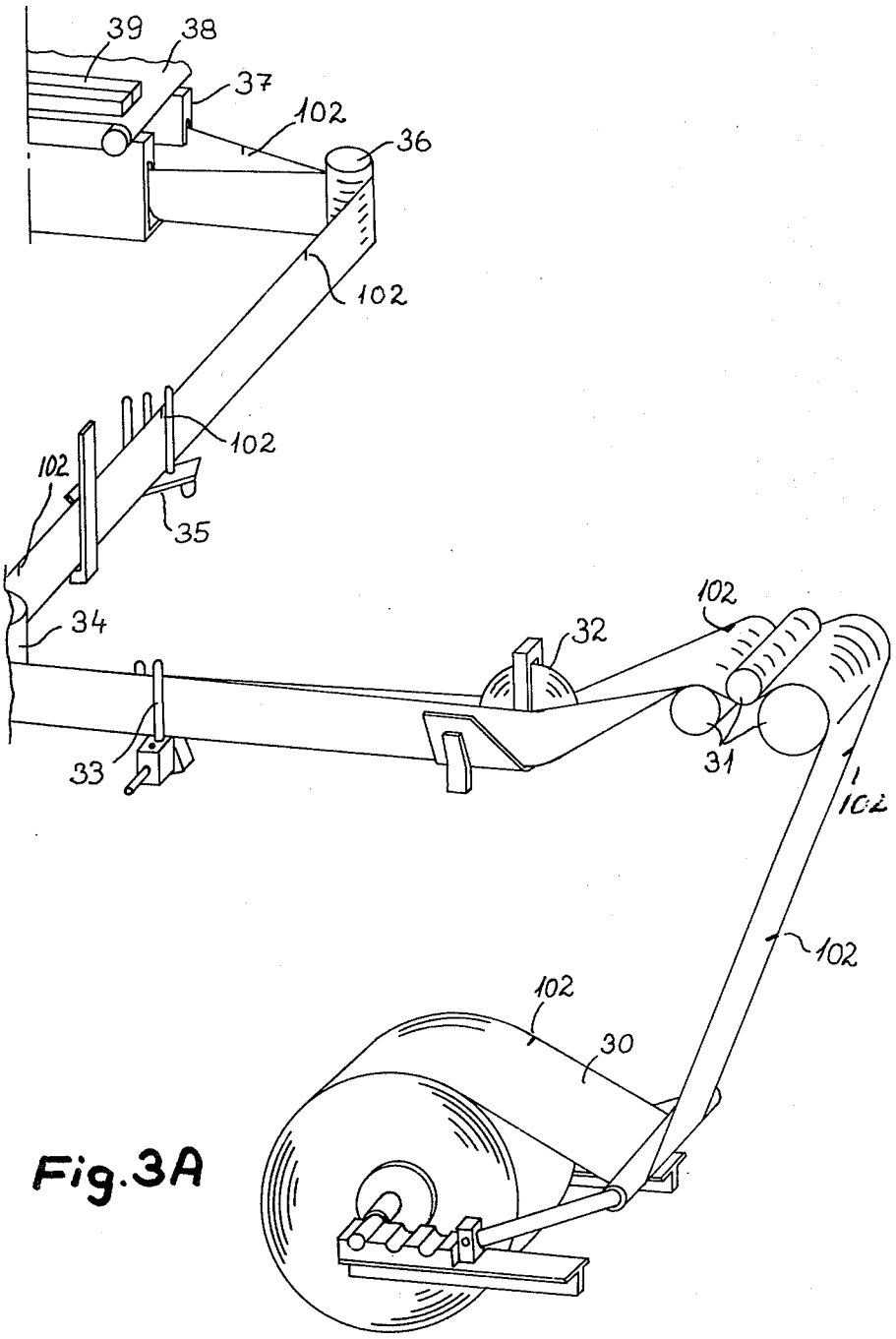
Figure 3B:
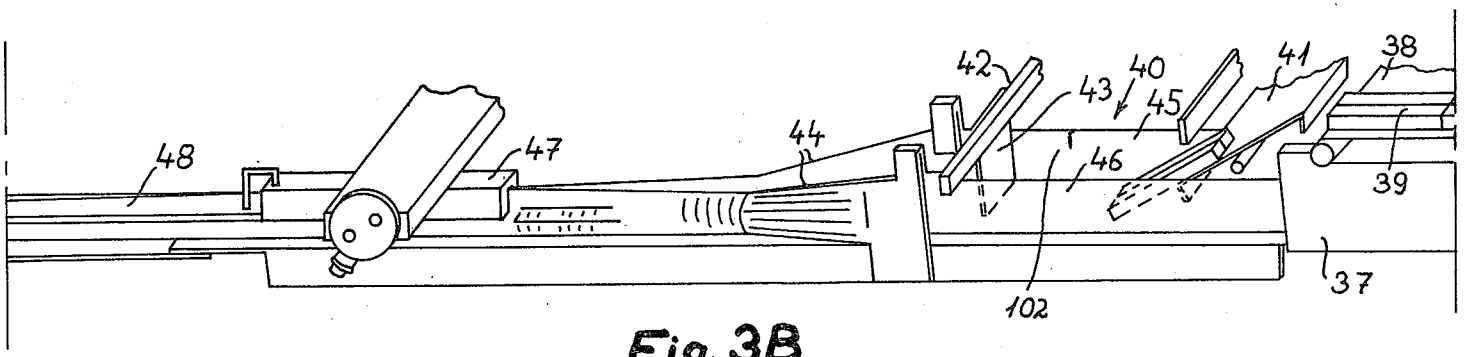
Figure 3C:
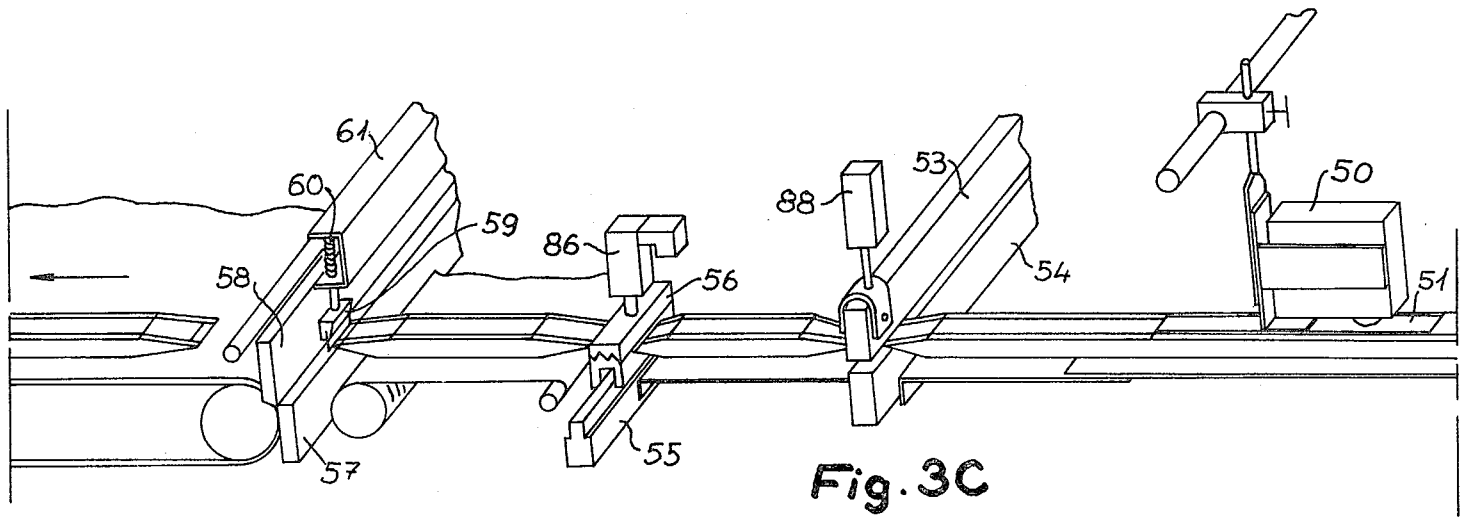

As mentioned above FIGS. 3A–3C show a packing line for a packing apparatus according to the present invention. The packing line in FIGS. 3A–3C operates from the right to the left, seeing that the upper part of FIG. 3A is to be arranged adjacent the right hand end of FIG. 3B and FIG. 3C is to be arranged in continuation of the left hand end of FIG. 3B. The line shown, accordingly, operates with a direction of machine which is opposite to the direction of machine which is opposite to the direction explained in connection with FIGS. 1 and 2.

It will be understood that more packing lines belong to the apparatus in question as explained in connection with FIGS. 1 and 2, but for the sake of clarity only one line has been shown and that line which is closest to a person observing the apparatus. 30 is a roll of strip formed packing material which is supported by a reel frame from which the strip is guided along a set of tension controlling rollers 31, through a set of shapping means 32 for folding the strip along the center line of the strip, a set of guiding fingers 33, around a roller 34, through further guiding means 35, around a guiding roller 36, and into a shaping member 37 wherein a U-shaped cross section is applied to the strip. The number of shaping members 37 corresponds to the number of strips of material and are arranged side-by-side transversely with respect to the direction of the machine and above the shaping members an endless feeding conveyor 38 for the articles 39 to be packed is arranged. After the shaping members 37, a filling station 40 follows comprising a pivotable table 41 which is common for all the lines. The filling station 40 also comprises a gallows 42 which also extends along the full width of the apparatus and accordingly also is common for all the lines and extends transversely with respect to the lines. The gallows 42 supports a finger 43 for each strip. Then, for each line a set of guiding means 44 follows, by which the longitudinally extending margins 45, 46 of the strip are moved towards each other in order to be conducted into a longitudinally extending welding device 47 wherein a longitudinally extending welding seam 48 is made in such a way that the strip of material in question is formed into a tube and the articles arranged therein will be enclosed. After each device 47 for longitudinal welding, a phototransducer 50 is arranged, to which a guiding foot 51 belongs which serves to lay down the longitudinal seam 48. Then a set of heating means follows comprising an upper rail 53 which is common for all the lines and also a lower rail 54 which is common for all the lines. Both rails extend transversely with respect to the direction of the machine and after this set of heating means a set of clamping means follows, which comprises a lower rail 55 extending transversely with respect to the direction of the machine, and which is common for all the lines, and a number of pressure feet 56, the number of which corresponds to the number of lines, and which are arranged aligned with each other transversely with respect to the direction of the machine and above the lower rail 55. The set of heating means 53, 54 and the set of clamping means 55, 56 constitute a transverse welding station which is followed by a separating station comprising transversely extending cutting means in the form of a lower knife 57 and an upper knife 58. The lower knife 57 simultaneously forms an abutment for securing members 59, each biased by means of the springs 60. For each line one such securing member 59 is arranged and the securing members are movable against the forces of the springs 60 which are arranged in a rail 61 extending transversely with respect to the direction of the machine and which is lifted and lowered together with the corresponding upper knife 58 in such a way that the ends of the strips of material are secured immediately after a separation has been carried out.

As mentioned above, FIG. 4 illustrates a side view of a part of the apparatus and in FIG. 4 also the shaping members 37, the gallows 42 with the fingers 43, the guiding means 44, the longitudinally extending welding device 47, the phototransducers 50, the heating means 53, 54, the clamping means 55, 56, and the separation station are shown. However, of the latter only the knife 57 and the upper knife 58 are shown. Instead of a continuous upper clamping rail which extends throughout the width of the apparatus, the apparatus comprises a pressure foot 56 for each line.

FIG. 4 shows a part of a side view of the packing apparatus as seen directly from the side and inwardly towards the first packing line which is shown in FIGS. 3A–C. From FIG. 4 it will be seen that the apparatus comprises a driving device 66 for applying a reciprocating stroke movement to the transverse welding tools 53–55. The driving device comprises a housing 66 secured to the frame of the apparatus wherein a rack is movable in the longitudinal direction driven by a hydraulic cylinder (not shown). The rack drives a gear which pivots an arm 67 in a reversing pivoting movement of 180° as indicated by means of the arch formed arrow 68 in FIG. 5. A connecting rod 69 is connected with the arm 67, and the length of the connecting rod is adjustable, seeing that it is constructed as a telescope rod. An oblong hole 70, FIG. 5, is provided in the arm 67 in order to adjust the stroke length, viz. by means of a screw arrangement 71, FIG. 4. The opposite end of the connecting rod 69 is connected to a slide 72 comprising a bridge 73 which extends transversely of the direction of the machine and below all the packing lines. The bridge 73 supports a gear box 74 which is movably supported in the direction of the machine by means of a guiding rod 75 of which one is arranged at each side of the apparatus. Moreover, the bridge 73 supports a hydraulic cylinder 76, the piston rod 77 of which extends through the gear box 74 and is provided with a rack for engaging an intermediate gear 78 which engages a rack 79 which is also movable in the gear box 74 and which is extended upwards by means of a rod 80. Each of the two rods 77 and 80 supports, at the upper end, a transverse rod 81 and 82 respectively, which are arranged with a mutual distance in the vertical direction seeing that the rod 81 is arranged at a level below the packing lines whereas the other rod 82 is arranged above this level. The lower rod 81 supports the lower rails of the welding station, viz. the lower heating rail 54 and the lower clamping rail 55 whereas the upper rod 82 supports the clamping feet 56 and the upper heating rail 53. At the opposite side of the apparatus a drive arrangement corresponding to the arrangement just explained is arranged and between the upper rod of the latter and the upper rod 82 shown in FIG. 4 a transverse beam 84 is arranged in which the clamping feet 56 are suspended, viz, each by means of an air cylinder 86. Accordingly, the number of air cylinders 86 corresponds to the number of packing lines. Moreover, the opposite ends of the upper rods 82 arranged at each side of the apparatus are also mutually connected by means of a connecting rod and at each ends of the latter an air cylinder 88 is secured. The upper heating rail 53 is suspended by means of the piston rods 89 of the air cylinders 88. Also the drive arrangement at the opposite side of the apparatus is connected with the slide 72 which, accordingly, is movably supported at the opposite side of the apparatus.

With the exception of the facts that the upper clamping rail 56 is divided into a number of clamping feet corresponding to the number of packing lines; that the clamping feet 56 are suspended in the rods 82 by means of the individual air cylinders 86 and that of the upper heating rod 53 is suspended in the upper rods 82 by means of the air cylinders 88, the drive arrangement according to FIG. 4 generally corresponds to the drive arrangement which is used in connection with the known packing apparatus according to FIGS. 1 and 2.

One end of a traction rod 90 is connected to the gear box 74 and the opposite end of the traction rod is provided with a rack 91 which engages a gear 92 driving a cam 93 provided with a projection 94. A cam follower or hydraulic cylinder (not shown) cooperates with the cam 93 in order to lift the gallows 42 and, accordingly, also the fingers 43 when acted upon by means of the projection 94. In FIG. 4 the fingers 43 are shown in their lifted position.

A shifting rod 96 extends slidably through an eye 95 secured to the gear box 74 and the opposite end of the shifting rod 96 is connected with a sliding valve 97 in a housing 98. At each side of the eye 95 a stop ring 99 and 100 respectively are secured to the shifting rod 96.

The strips of packing material used in the packing apparatus shown have been illustrated without decoration, but the strips are in practice printed with patterns having a pitch corresponding to the length of a final packing. Moreover, a row of indications is printed along one edge of each strip, viz, the edge which will be positioned uppermost when the longitudinally extending welding seam is laid down. According to the embodiment illustrated the indications are provided in the form of spots 102 which, by passing the phototransducers 50, activate the transducers in such a way that they issue pulses which are individual for each strip. The pulses are by control lines A transferred to a control unit, CU, which by control lines B controls the air cylinders 86 for individual lifting of the clamping feet 56. On the shifting rod 90 an activator 103 is secured for shifting a microswitch 104, which is also by a control line C connected with the control unit CU, which, when a pulse is received from the microswitch 104 during the forward movement of the shifting rod 90 (to the left in FIG. 4) via control lines D activates the air cylinders 88 for lifting the upper heating rail 53.

The packing apparatus shown operates in the following way:

Before starting the apparatus, the strips of packing material are threaded through the different parts of the apparatus as previously explained in connection with FIGS. 1 and 2. Such threading is carried out in a position of the sets of welding means 53–56 wherein these sets are open. During the threading of the strips, due care should be taken for arranging an indication 102 on each strip immediately in front of the phototransducer 50 corresponding to the strip in question. Now the apparatus is prepared for being started, and articles are deposited in each strip at the filling station 40. In the present instance one article is deposited in each strip. However, it will be understood that nothing prevents depositing a portion of articles at each filling operation. Now the driving device 65 is started, whereby the welding tools are moved to their right end position (which is shown in FIG. 4). Upon arrival at this position, the eye 95 will abut the stop ring 100 whereby the shifting rod 96 and, accordingly, also the corresponding slide valve 97 will be shifted whereby the cutting device 57,58 is being opened and the securing feet 59 are lifted. Simultaneously, the hydraulic cylinder 76 will be activated so as to move the rods 81 and 82 towards each other whereby the welding means are brought into engagement, viz, to the position shown in FIG. 4. Now the welding tools are moved to the left in FIG. 4 by means of the driving device 65 and during this movement the heating means 53, 54 will heat the strips at the parts caught by the heating means 53, 54. After approximately 80% of the forward stroke has been done, the activator 103 activates the microswitch 104 which, as explained above, causes the air cylinders 88 to lift the upper heating rail 53. During the continuation of the forward stroke, the clamping feet 56 remain engaged with the packing strips and, accordingly, provide for the drawing forward of the strips, viz, until the clamping feet 56 are lifted individually before the termination of the stroke, viz, by means of the air cylinders 86 activated by pulses from the corresponding phototransducers 50. At the termination of the forward stroke the eye 95 abuts the stop ring 99, whereby the shifting rod 96 and accordingly also the slide valve are shifted, whereby the cutting device is closed in order to cut-off the finished packings and to secure the ends of the packing strips by means of the securing feet 59 and, simultaneously, the cylinder 76 is activated in direction for moving the welding tools away from each other. This latter movement of disengagement is greater than the individual movement of disengagement of the clamping feet 56 and the intermediate movement of disengagement of the heating rail 53. This latter disengagement are done by means of comparatively small movements, viz, just enough to release the packing material. Accordingly, it will be understood that the clamping feet 56 combined with a lower clamping rail 55 dominate as regards the distance each individual strip of material is moved forward per stroke, and due to the fact that this distance is controlled individually by means of the phototransducers 50, it is always possible to arrange for releasing the strips of material from the clamping feet 56 at transverse alignment of the patterns of the strips due to the fact that the phototransducers 50 are aligned with each other transversely with respect to the direction of the machine. Accordingly, due to the fact that the indications 102 register with the patterns of the strips, the patterns will always be moved in the direction of the machine aligned with each other and will remain in this alignment during the operation of the apparatus. During the last part of the forward stroke, the fingers 43 are lowered by means of the cam arrangement 93,94 whereby the following row of articles will be stopped and will slide with respect to the corresponding strips in such a way that the articles, or heaps of articles, will be aligned with each other transversely with respect to the direction of the machine. The stroke length of the driving device is a little longer than the pitch of the finished packings, and, accordingly, also a little longer than the distance between the centers of the two sets of welding means 53, 54 and 55, 56 respectively, and, accordingly, also the possibility exists that the clamping feet 56 may draw a strip, which has indications with a pitch which is a little too long, a little longer forward then corresponding to the length of a packing and, accordingly, it is also possible to compensate for a too great distance between the indications 102. A too small distance between the indications, on the other hand, results in an early lifting of the clamping feet 56, and accordingly, it is by means of the arrangement according to the present invention possible to compensate for variations as regards the indications and accordingly also the pitch of the patterns.

According to the embodiment illustrated on the drawing, the upper clamping rail has been divided into individual clamping feet. However, nothing prevents a division of the upper heating rail 53 into individual clamping feet and to use an upper clamping rail which extends along the full width of the apparatus. In the latter instance the upper clamping rail must be released first during the forward stroke and the feeding clamping feet must dominate the advancing the strips individually. However, the latter arrangement may, under certain circumstances, be more complicated than the arrangement explained above, viz, in cases where the packing material used necessitates heating from both sides during the heating period, because a division of the upper heating rail 53 into individual feet necessitates the imbedding of a heating element into each foot. However, if the material requests heating from one side only, it is sufficient to provide only the lower heating rails 54, which is continuous along the full width of the apparatus, with heating elements. Also a division of the upper heating rail 53 may, under certain circumstances and in particular if an extremely heat sensitive packing material is used, be inappropriate because the periods of heating will not be constant from stroke to stroke due to the individual release.

Also an embodiment is possible according to which both the upper clamping rail and the upper heating rail are divided into individual feet because such feet may be suspended pairwise in the connecting rod which connects the upper rods 82 with each other, viz, the connecting rod 84 and the connecting rod (not shown on the drawing) at the opposite ends of the rod 82 and wherein each pair of feet is suspended by means of an individually controlable disengagement device. In the latter instance both sets of welding means for each strip, accordingly, will be disengaged individually and simultaneously with each other.

I claim:

1. Apparatus for packing articles in a plurality of packing lines into a number of strips of packing material and for sealing and severing the strips between adjacent articles, comprising a filling station having means for arranging the articles into the strips; a longitudinal welding station having means for welding the longitudinally extending margins of each strip together for forming a plurality of packing tubes; a slide and a guiding means for guiding the slide in the longitudinal direction of the strips; a driving device connected to the slide for applying a reciprocating movement to the slide between an upstream position and a downstream position, the distance between said positions being longer than the length of the packings to be made; a set of heating means supported by the slide and comprising an upper and a lower rail extending transversely with respect to and above and below the plurality of strips, a set of clamping means downstream from said heating means also supported by the slide and comprising a clamping rail extending transversely with respect to the plurality of strips at one side of the strips, and a number of clamping feet corresponding to the number of strips, the clamping feet being arranged opposite the clamping rail and along the other side of the strips, the set of heating means and the set of clamping means being arranged on the slide with a mutual distance corresponding to the length of the packings to be made, moving means further supported by the slide for moving the set of heating means and the set of clamping means into engagement with the tubes so as to respectively heat the tubes between two adjacent articles in each tube and to clamp previously heated portions of the tubes between two adjacent articles in each tube, and the apparatus being provided with activating means adapted to activate said moving means so as to cause engagement of the set of heating and the set of clamping means with respect to the tubes adjacent the upstream position of the slide, further moving means still further supported by the slide for disengaging the heating means with respect to the tubes, and the apparatus being provided with further activating means adapted to activate said moving means for disengaging the heating means at a predetermined intermediate position of the slide between the upstream and the downstream positions, the distance between the intermediate position and the upstream position being shorter than the length of the packings to be made; individual moving means still further supported by the slide for individually disengaging the clamping feet, and the apparatus being provided with individual sensing means positioned upstream with respect to the upstream position of the slide and adjacent each strip so as to activate said individual moving means for individually disengaging the clamping feet in correspondence with pulses caused by indications provided on each strip and having a pitch corresponding to the required length of the packings to be made and so as to disengage the clamping feet individually at positions of the slide between the intermediate position and the downstream position of the slide, the apparatus, moreover, having a separation station comprising cutting means and securing means for respectively severing said tubes into individual packings and to secure the cut ends of the tubes during the return stroke of th slide; the apparatus, moreover, having means for activating said cutting and said securing means at the termination of the forward stroke of the slide and for disengaging the securing means at the termination of the return stroke of the slide.

2. Apparatus according to claim 1, wherein the moving means for disengaging the heating means and the individual moving means for individually disengaging the clamping feet are supported with respect to the slide by the means for moving the set of heating means and the set of clamping means into engagement with the strips.

3. Apparatus according to claim 2, wherein the means for moving the set of heating means and the set of clamping means into engagement with the strips are adapted so as to move the set of heating means and the set of clamping means in direction away from the strips, and wherein the apparatus has activating means adapted to activate said moving means for moving the set of heating means and the set of clamping means in said direction at the termination of the forward stroke of the slide.

* * * * *